US007748328B2

(12) United States Patent
Horton

(10) Patent No.: US 7,748,328 B2
(45) Date of Patent: Jul. 6, 2010

(54) ITEM OF FURNITURE

(75) Inventor: George Horton, Warwickshire (GB)

(73) Assignee: Floreat Fortuna, LLC, Los Angeles, CA (US)

( * ) Notice: Subject to any disclaimer, the term of this patent is extended or adjusted under 35 U.S.C. 154(b) by 502 days.

(21) Appl. No.: 11/571,350

(22) PCT Filed: Jun. 30, 2005

(86) PCT No.: PCT/GB2005/002580

§ 371 (c)(1),
(2), (4) Date: Dec. 27, 2006

(87) PCT Pub. No.: WO2006/003406

PCT Pub. Date: Jan. 12, 2006

(65) Prior Publication Data

US 2008/0035030 A1 Feb. 14, 2008

(30) Foreign Application Priority Data

Jul. 1, 2004 (GB) ..... 0414735.1

(51) Int. Cl.
*A47B 37/00* (2006.01)

(52) U.S. Cl. ..... 108/50.01; 108/25; 312/223.2; 312/223.3

(58) Field of Classification Search ..... 108/50.01, 108/50.02, 33, 25, 26; 312/293.1, 223.1, 312/223.2, 223.3
See application file for complete search history.

(56) References Cited

U.S. PATENT DOCUMENTS 4,766,422 A * 8/1988 Wolters et al. ..... 312/223.3
5,437,235 A * 8/1995 Randolph ..... 108/25
5,526,756 A * 6/1996 Watson ..... 108/50.01
5,797,666 A * 8/1998 Park ..... 312/223.3
5,845,587 A * 12/1998 Ditonto ..... 108/50.01

(Continued)

FOREIGN PATENT DOCUMENTS

DE 20113322 U1 1/2002

(Continued)

OTHER PUBLICATIONS

International Search Report mailed Sep. 19, 2005, in related International Application No. PCT/GB2005/002580, filed Jun. 30, 2005 (2pgs).

(Continued)

*Primary Examiner*—José V Chen

(57) ABSTRACT

A desk for use as a computer workstation has a generally planar work surface having first and second portions; a monitor storage space beneath the first portion on and a monitor support that is movable between a retracted attitude iii which the support is in the storage space and an extended attitude in which the support extends above the work surface. The first portion is movable between a closed position in which the first portion forms a part of the generally planar work surface and overlies the storage space to prevent movement of the support and an open position in which the first portion a flows movement of the support between the retracted and extended attitudes. When the support is in the extended attitude, a monitor attachment coupled thereto is movable along horizontal and vertical axes to enable the position of the monitor above the work surface to be adjusted.

18 Claims, 3 Drawing Sheets

U.S. PATENT DOCUMENTS

| | | | | |
|---|---|---|---|---|
| 5,878,673 | A * | 3/1999 | Kramer et al. | 108/50.02 |
| 5,897,178 | A * | 4/1999 | Ohara | 312/223.2 |
| 6,007,036 | A * | 12/1999 | Rosen | 248/286.1 |
| 6,609,465 | B2 * | 8/2003 | Kolavo | 108/50.01 |
| 7,063,024 | B2 * | 6/2006 | Latino | 108/50.01 |
| D532,990 | S * | 12/2006 | Sapp | D6/425 |
| 7,178,469 | B2 * | 2/2007 | Goza | 108/50.01 |
| 2003/0037709 | A1 | 2/2003 | Kolavo | |
| 2006/0174807 | A1 * | 8/2006 | Dral et al. | 108/50.01 |

FOREIGN PATENT DOCUMENTS

| | | | |
|---|---|---|---|
| DE | 10153492 | A1 | 6/2006 |
| JP | 09327335 | A | 12/1997 |

OTHER PUBLICATIONS

International Preliminary Report on Patentability mailed Nov. 23, 2006, in related International Application No. PCT/GB2005/002580, filed Jun. 30, 2005 (7pgs).

* cited by examiner

ITEM OF FURNITURE

The present invention relates to an item of furniture for use as a computer workstation, in particular, but not exclusively, for use with a PC.

A conventional PC consists of a processor unit, a keyboard for user interaction with the processor unit, and a monitor or display screen for displaying information from the processor unit to the user. In general, the PC, or at least a monitor for the PC, will be located on a desk or other surface, often referred to as a workstation.

Nowadays, it is relatively uncommon to find an office, school, university, library, or even domestic home that does not include at least one PC. The increase in worldwide popularity of the internet and intranet style platforms as a resource tool for education and commerce has, to an extent, contributed to the proliferation of PCs in the everyday fabric of modern society.

It is an object of the invention to provide an improved item of furniture for use as a computer workstation.

According to the present invention there is provided furniture for use as a computer workstation, the furniture including a generally planar work surface and means for supporting a computer display screen above the work surface, said support means being adapted to be moved between a stowed position below the work surface and an extended position above the work surface.

Preferably, with the support means in its stowed position, the work surface defines a normal working area, A, and in which, with the support means in the extended position, the normal working area is substantially the same as with the support means in its stowed position.

Conveniently, the furniture may include a storage portion for receiving the support means in the stowed position.

Preferably, the furniture includes a cover portion movable between an open position in which the support means can be moved to or from the stowed position, and a closed position in which, with the support means in an extended position, said cover portion acts to prevent the support means from being moved to the inoperative position.

In a preferred embodiment, the cover portion forms part of the work surface.

The furniture may include means for selectively opening the cover portion.

In a preferred embodiment, the support means includes a mounting member adapted for movement in a vertical axis relative to the work surface, which mounting member may also be rotatable.

The support means may include an arm portion connected to the mounting member, said arm being adapted for supporting a computer display screen, preferably pivotably connected to the mounting member.

The invention may include means for automatically raising or lowering the support means, for example an hydraulic arrangement Conveniently, the furniture may include a housing portion for receiving a computer processor.

Other preferred features of the invention will be apparent from the following description and from the dependent claims.

The invention will now be described, by way of example only, with reference to the accompanying Figures, in which.

Figure 1:
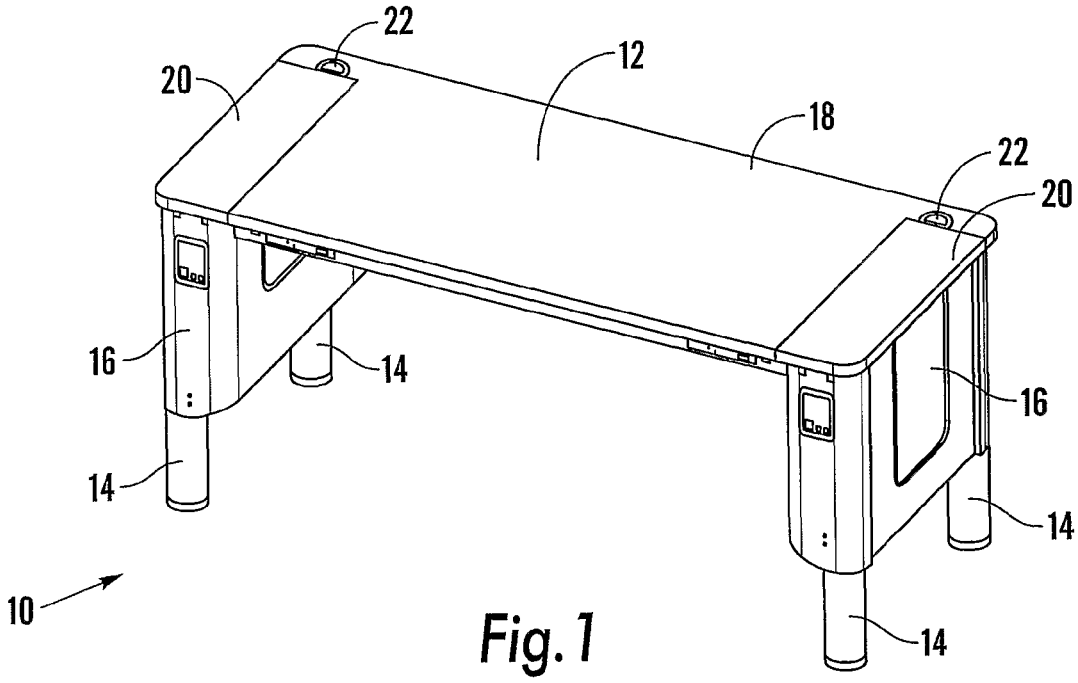
FIG. 1 is a schematic perspective view from the front of a preferred form of an item of furniture in the form of a desk in accordance with the present invention, in which the desk is shown in a closed attitude.

Referring to FIG. 1, an item of furniture for use as a computer workstation is indicated generally at 10, in the form of a desk.

As can be seen, the desk 10 includes a main body and a generally planar upper surface 12, here in the form of a lid, shown in its normal working position. The lid enables the desk 10 to be used in a conventional manner, for example as a desk for use in a school classroom. It will be understood that upper surface 12 is suitable for use for in supporting a computer keyboard, mouse and office, school, domestic or other stationery. The main body of the desk 10 and the lid 12 are generally rectangular in shape, as can be seen from FIG. 1.

The desk 10 has four legs 14 and defines first and second ends, to the left and right as viewed in FIG. 1. In this embodiment, the desk 10 is in the form of a twin desk, adapted for use by two persons, for example two school pupils and in its simplest form the two halves of the desk are mirror images of one another. A storage space 30, defined by a respective housing portion 16, is formed at each end of the desk 10. Each storage space 30 extends below the lid 12 of the desk and between the legs 14 at the respective end of the desk 10.

The lid 12 of the desk 10 has first and second portions 12, 20. The first portion is formed by a housing closure or cover 20, one being formed at each side of the desk, and the second portion is formed by a primary desktop portion 18. Each of the housing closures or covers 20 serve as closures for a respective aperture 22, which allow access to the associated storage space 30.

Figure 2:
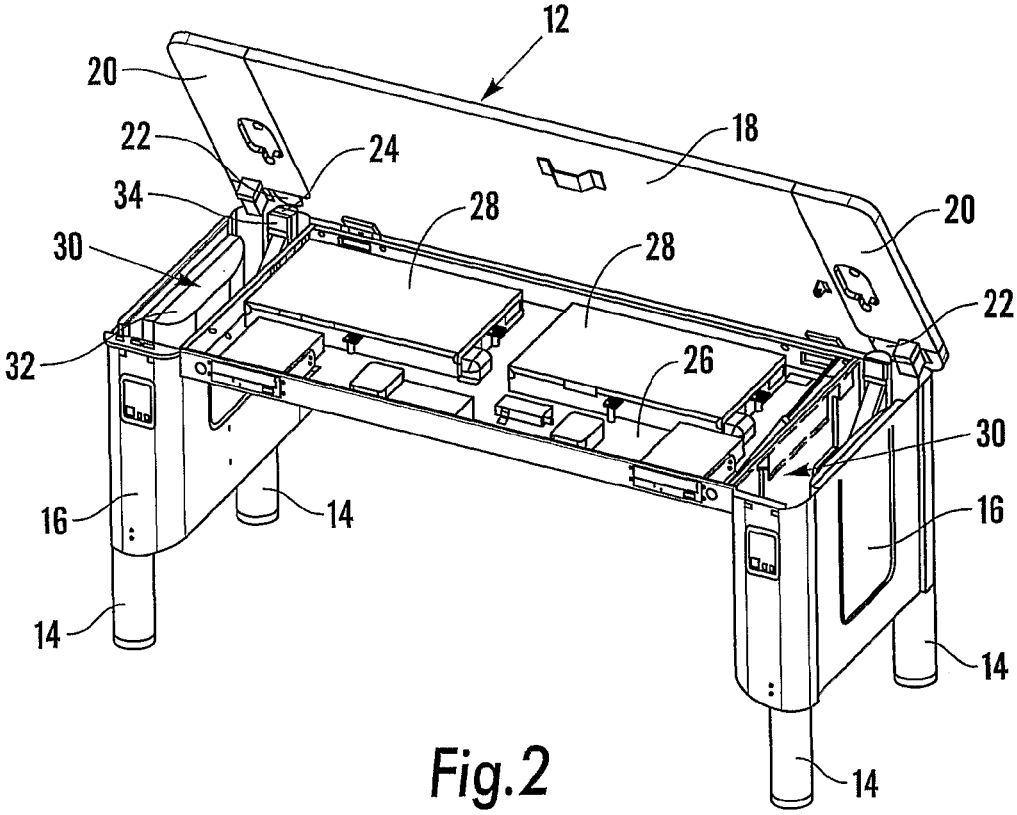
FIG. 2 is a view similar to FIG. 1, showing the desk in an open attitude.

Referring now to FIG. 2, the desk 10 is shown in a fully open attitude. As can be seen, the lid is connected to the main body of the desk 10 by means of hinged connections 24 extending substantially along one longer side of the desktop portion 18. This enables the lid 12 to be moved between the closed attitude shown in FIG. 1 to the open attitude shown in FIG. 2.

The main body of the desk 10 includes a central housing portion indicated at 26, which is covered by the desktop portion 18 when the desktop portion 18 is in its closed attitude. A pair of computer processor units 28 are provided in the central housing portion 26, access to which can only be gained when the desktop portion 18 is in its open attitude. Support means, not shown, are provided in the form of a strut, for supporting the desktop portion 18 in its open position, to enable safe working access to the central housing portion 26. Also, air vents (not illustrated) are provided in the bottom of the central housing portion 26, beneath the position of the processors 28.

Each storage space 30 is provided primarily as a storage housing for a computer monitor. A flat-type computer monitor 32 is illustrated in the storage space 30 at the left hand end of the desk 10 as viewed in FIG. 2, in a stowed position within the storage space 30.

Although each storage space 30 is shown as being defined by the walls of the respective housing portion 16, it would be appreciated that the storage space 30 can simply be an open space beneath the lid 12 of the desk for receiving the computer monitor 32. However, in order to protect the monitor, it is preferable that the storage space is formed by some form of protective housing such as the housing 16.

The monitor 32 is mounted on a support means in the form of a support assembly, indicated generally at 34, for movement of the monitor 32 between its stowed position and an extended position above the normal working position of the upper surface 12 of the desk 10, as will be described in more detail below.

From FIGS. 1 and 2, it will be understood that each cover 20 is arranged generally above the storage space 30 defined by a respective housing portion 16, so as to provide a cover for the monitor 32 and support assembly 34 in its stowed position. In order to gain access to the monitor 32 and processors 28, the lid 12 can be raised from its normal working position in FIG. 1, as indicated in FIG. 2. However, each cover 20 is connected to the desktop portion 18 for hinged movement between a closed position, as shown in FIG. 1, and an open position. Hence, each cover 20 can be opened, independently of the desktop portion 18, as described below, for access to the monitor 32.

The support assembly 34 and method of moving the monitor 32 from the stowed position within the desk 10 illustrated in FIG. 1, to an extended, working position, will now be described.

Figure 3:
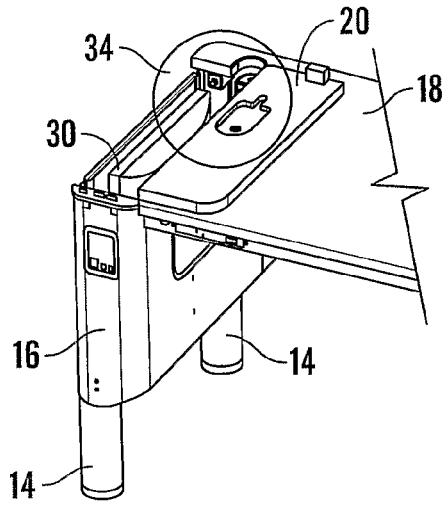
FIG. 3 is a view similar to FIGS. 1 and 2, showing only one half of the desk, with the desktop in a closed position and a cover portion in an open position.
Figure 4:
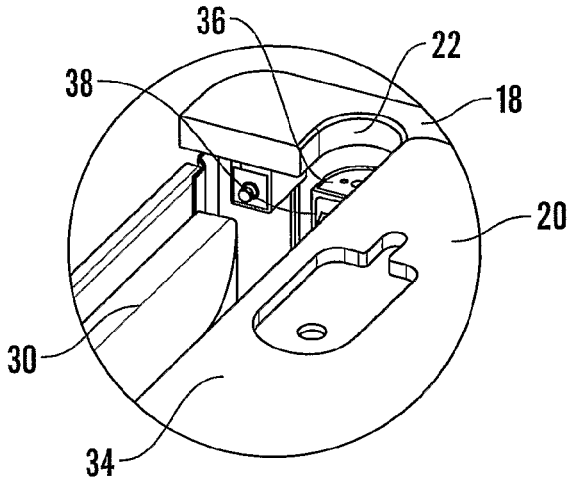
FIG. 4 is a detail from FIG. 3, showing part of a support assembly.
Figure 5:
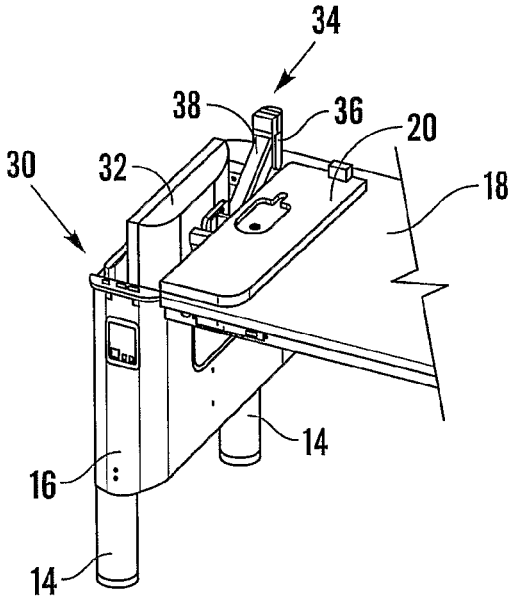
FIG. 5 is a view similar to FIG. 3, with a base mounting of the support assembly shown in a fully extended position and the monitor in a partially raised position.

Referring to FIG. 3, the desk 10 is shown with the desktop portion 18 in its normal working position. The left hand cover 20 has been moved to its fully open position relative to the desktop portion 18, to enable access to the storage space 30. Due to the angle of perspective of FIG. 3, the monitor 32 is partially obscured from view by the cover 20 in this view. However, an arm 38 of the support assembly 34 is visible, which is shown more clearly in FIG. 4.

The support assembly 34 includes a mounting means, here in the form of an elongate member 36. The member 36 is adapted for movement in a vertical axis relative to the desk 10 between a stowed position illustrated in FIGS. 1 to 4 and an extended position shown in FIGS. 5 to 8. The member 36 is arranged so as to pass through the aperture 22 in the desktop portion 18, when moving between its extracted and extended positions. The member 36 is also rotatable about the vertical axis. The member 36 may be adapted for movement vertically in a number of ways. For example, it may be in the form of a telescopic member, which can extend or retract along the vertical axis or may be mounted as a slide member in a guide, which is secured relative to the desk 10 within the storage space 30.

An arm 38 is connected to the member 36, so as to be movable between and through a number of different positions relative to the member 36, and for rotation with the base mounting 36. The monitor 32 is connected to attachment means at a free end of the arm 38, and is shown, in a number of sequentially raised positions relative to the desk 10, for the purposes of description, in FIGS. 5 to 8.

The arm 38 may be connected to the member 36 by means of a joint which allows pivoting of the arm 38 about a vertical axis only, or about both vertical and horizontal axis. The connection of the arm to the member 36 may conveniently be by way of a universal joint, which may include a clamping means for clamping the joint to fix the arm 38 in a pre-selected angular position relative to the member 36. However, in the illustrated embodiment, the arm 38 is pivotable on the member 36 only about a generally horizontal axis.

Figure 6:
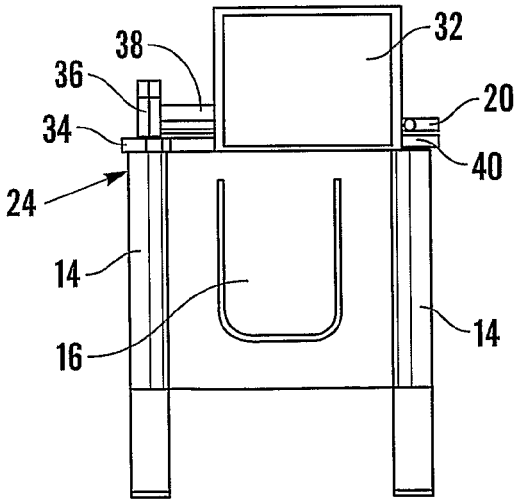
FIG. 6 is a view from the left hand end of the desk in FIGS. 1 to 5, showing the support arm and monitor in a partially raised position.
Figure 7:
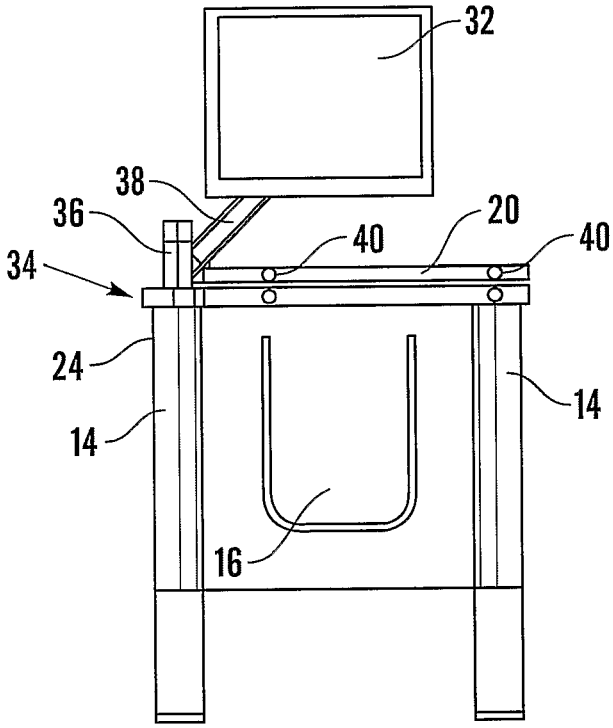
FIG. 7 is a view similar to FIG. 6, showing a support arm and the monitor in a fully extended position.

To raise the support assembly 34, the user raises the monitor 32, which causes the member 36 to rise vertically, the support arm 38 is being raised with the member 36 The member 36 moves directly in its vertical axis, up through the aperture 22, to its fully extended position shown in FIGS. 5 to 8. A stop means, not illustrated, prevents further movement upward and holds the member 36 in its extended position. The stop means may be in the form of a simple latch mechanism which holds the member 36 in its extended position, or in the form of a stop and manually actuable clamp. As the monitor 32 is raised further, the arm 38 pivots about its connection with the member 36, from a generally downwardly depending position shown in FIG. 5, through a generally horizontal position shown in FIG. 6, up to an extended position relative to the normal working surface 12 of the desk 10, as shown in FIG. 7.

In FIGS. 6 and 7, it can be seen that each cover 20 is connected to the desktop portion 18 by a pair of hinges 40. The attachment, typically a universal joint, between the monitor 32 and the support arm 38 is also clearly visible, by means of which the monitor 32 can be tilted, rotated or raised/lowered relative to the arm 38, as required by a user.

Figure 8:
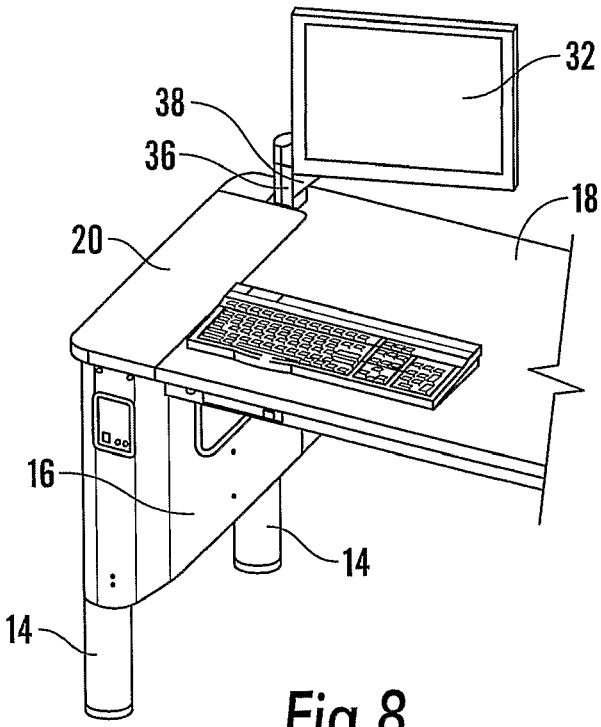
FIG. 8 is a view of the left hand end of the desk, showing the desk in an IT-operative condition, with the monitor in an operative extended position and the cover portion in a closed position.

Since the member 36 is rotatable about a vertical axis, the arm 38 and monitor 32 can be moved from the position shown in FIG. 7, to the position shown in FIG. 8, for use by a user sat in front of the desk 10.

With the member 36 in its fully extended position and the monitor 32 and support arm 38 suitably positioned, a user can close the cover portion 20, so as to be completely flush with the rest of the working surface 12 of the desk 10, as illustrated in FIG. 8. A keyboard and mouse can be stored with the monitor 32 in the storage space 30, so as to be removable when the cover 20 is opened, for use with the monitor 32 and processor 28.

In the position shown in FIG. 8, the desk 10 functions as a computer workstation, with almost no reduction in the normal working area of the upper surface of the desk 10 from the position shown in FIG. 1. It will be understood the operation described above for extending the monitor 32 and support assembly 34 is simply reversed, in order to return the monitor 32 to its stowed position within the desk 10.

In a preferred embodiment of the invention, the desk may include means for selectively opening the storage cover and/or main desktop area. For example, a button-operated locking mechanism can be provided for locking the cover/desktop portion in its normal working position. To open the cover/desktop portion, a user must press a button located on the front of the desk which causes the storage cover and/or desktop portion to raise up by about 2 cm above its normal working position. This enables the user to swing open the cover portion/desktop area, in order to access the storage or central housing area. To close the cover/desktop portion, the user simply pushes the cover or desktop portion closed. The desktop portion can also be locked separately from the cover portion to allow access to the latter but not to the central housing portion 26 and the processor units 28.

The locking mechanism is configured in this manner so that closing the cover portion/desktop portion requires a two-handed operation, i.e. one hand to depress the button, and the other to move the cover portion/desktop portion, to reduce the risk of the user trapping fingers in the desk during said closing operation.

In addition to the purely mechanical arrangement for moving the support assembly between its raised and lowered positions, a preferred embodiment of the invention may include means for automatically raising or lowering the support assembly. For example, a button operated hydraulic control device can be used in connection with the member 36, which includes means for selectively raising and lowering the member 36, in response to a user pressing a button provided in the front of the desk.

It will be understood that the item of furniture in accordance with the invention provides a means by which a user can have a contiguous, planar desktop surface which has no evidence or intrusion of any IT equipment. A particular advantage of the invention is that the support means can be raised from a stowed position below the level of the desktop surface to an extended position for supporting a computer monitor above the desktop surface, without any significant reduction in the effective working area of the desktop surface.

A further advantage of a preferred embodiment of the invention is that the item of furniture provides a convenient means for securably stowing away IT equipment (monitor, processor, keyboard and mouse) within the furniture, without the need for unsightly security means, such as Kensington cables or metal cages on or adjacent the desktop, for example. Also, IT equipment can be easily stored within the furniture, it is a further advantage of preferred embodiments of the invention that they can be provided with alarms to indicate and ward off attempts at unauthorized access.

Although the desk shown in FIGS. 1 to 8 is illustrated as being a two-person desk, the furniture can be in the form of a single person desk. In preferred embodiments, the housing can be provided at the front or rear of the desk, or other suitable location.

The furniture can be of any suitable form, for example, in the form of a shelving unit, kitchen unit or any other furniture having a surface suitable for a PC monitor.

The invention claimed is:

1. An item of furniture for use as a computer workstation having:

a generally planar work surface having first and second portions;

a storage space beneath said first portion of the work surface configured for storing a monitor;

and support means configured to support said monitor relative to said work surface, said support means having attachment means for attachment to said monitor;

wherein:

said support means is movable between a retracted attitude in winch said support means is in said storage space and an extended attitude in which said support means extends above said work surface for supporting said monitor above and spaced from said work surface;

said first portion of said work surface is includes structure to allow movement between a closed position in which said first portion forms a part of said generally planar work surface and overlies said storage space thereby to prevent movement of said support means from either one of said retracted and extended attitudes to the other, and an open position in which said first portion allows movement of said support means between said retracted and extended attitudes;

said support means includes a first member mounted for linear movement along a vertical axis relative to the work surface between said refracted amid extended attitudes, said second portion of the planar work surface includes an aperture for said first member to allow said first portion to move from said open position to said closed position when said support means is in said extended attitude;

and wherein, when said support means is in said extended attitude said attachment means is movable to enable the position above said work surface to be adjusted.

2. An item of furniture as claimed in claim 1, wherein, when said support means is in said extended attitude said attachment means is movable to enable the position of said monitor above said work surface to be adjusted.

3. An item of furniture as claimed in claim 1, wherein said first member is rotatable about said vertical axis.

4. An item of furniture as claimed in claim 1, in which the item of furniture includes means for selectively opening the cover portion.

5. An item of furniture as claimed in claim 1, in which the support means mounts said attachment means to said desk so as to enable movement of said attachment means in generally horizontal and vertical planes above said work surface when said support means is in its extended attitude.

6. An item of furniture as claimed in claim 1, in which the first member is an elongate member.

7. An item of furniture as claimed in claim 1, in which the first member is rotatable about said axis for moving said monitor in a generally horizontal plane.

8. An item of furniture as claimed in claim 1, in which the support means includes an arm connected to the first member, said arm having said attachment means for attaching and supporting a computer display screen.

9. An item of furniture as claimed in claim 1, in which said arm is connected to the first member so as to be movable about a generally horizontal axis for moving said computer screen in a generally vertical plane.

10. An item of furniture as claimed in claim 1, in which a computer display screen is mounted on the support means so as to be stowable with the support means in said storage space.

11. An item of furniture as claimed in claim 1, in which the includes for automatically moving said support means between said retracted and extended attitudes.

12. An item of furniture as claimed in claim 11, in which the moving means is operable to raise and lower said first member along said vertical axis for automatically moving said support means between said refracted and extended attitudes.

13. An item of furniture as claimed in claim 11, in which the moving means includes an hydraulic arrangement.

14. An item of furniture as claimed in claim 1, in which the display screen is a flat-type monitor.

15. An item of furniture as claimed in claim 1, in which the item of furniture includes a housing portion for receiving a computer processor.

16. An item of furniture as claimed in claim 15, in which said generally planar work surface is formed by a lid of said item, said lid serving as a closure for said housing portion.

17. An item of furniture as claimed in claim 1, in which a computer processor is housed within the item of furniture.

18. An item of furniture as claimed in claim 1, in which said storage space comprises a compartment closed by said first portion of said work surface.

* * * * *